US008859485B2

(12) United States Patent
Yue et al.

(10) Patent No.: US 8,859,485 B2
(45) Date of Patent: Oct. 14, 2014

(54) ETHYLENE ACRYLIC ACID COPOLYMER AQUEOUS DISPERSIONS FOR FRAGRANCE RELEASE IN LAUNDRY DETERGENTS

(75) Inventors: Chaofang Yue, Midland, MI (US); David Malotky, Midland, MI (US); J. Keith Harris, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/988,617

(22) PCT Filed: Dec. 12, 2011

(86) PCT No.: PCT/US2011/064424

§ 371 (c)(1), (2), (4) Date: May 21, 2013

(87) PCT Pub. No.: WO2012/082624

PCT Pub. Date: Jun. 21, 2012

(65) Prior Publication Data

US 2013/0274169 A1 Oct. 17, 2013

Related U.S. Application Data

(60) Provisional application No. 61/424,497, filed on Dec. 17, 2010.

(51) Int. Cl.

| | |
|---|---|
| ***C11D 3/06*** | (2006.01) |
| ***C11D 3/10*** | (2006.01) |
| ***C11D 3/08*** | (2006.01) |
| ***C11D 3/50*** | (2006.01) |
| ***C11D 3/37*** | (2006.01) |
| ***C11D 3/39*** | (2006.01) |
| ***C11D 3/20*** | (2006.01) |

(52) U.S. Cl.

CPC *C11D 3/507* (2013.01); *C11D 3/50* (2013.01); *C11D 3/06* (2013.01); *C11D 3/3757* (2013.01); *C11D 3/3942* (2013.01); *C11D 3/10* (2013.01); *C11D 3/08* (2013.01); *C11D 3/2086* (2013.01)

USPC ..... 510/475; 510/302; 510/318; 510/361; 510/422; 510/434; 510/477; 510/488; 8/137

(58) Field of Classification Search

USPC ..... 510/302, 318, 361, 422, 434, 475, 477, 510/488; 8/137

See application file for complete search history.

(56) References Cited

U.S. PATENT DOCUMENTS

| | | | | |
|---|---|---|---|---|
| 3,798,194 | A | 3/1974 | McCann | |
| 4,599,392 | A | 7/1986 | McKinney et al. | |
| 4,701,432 | A | 10/1987 | Welborn, Jr. | |
| 4,839,077 | A * | 6/1989 | Cramer et al. | 510/373 |
| 4,988,781 | A | 1/1991 | McKinney et al. | |
| 5,272,236 | A | 12/1993 | Lai et al. | |
| 5,322,728 | A | 6/1994 | Davey et al. | |
| 5,938,437 | A | 8/1999 | DeVincenzo | |
| 6,525,157 | B2 | 2/2003 | Cozewith et al. | |
| 6,960,635 | B2 | 11/2005 | Stevens et al. | |
| 7,214,652 | B1 * | 5/2007 | Jariwala | 510/380 |
| 2005/0176599 | A1 * | 8/2005 | Bergquist et al. | 510/101 |
| 2005/0272878 | A1 | 12/2005 | Corzani et al. | |

FOREIGN PATENT DOCUMENTS

| | | | |
|---|---|---|---|
| WO | 0194521 | A1 | 12/2001 |

* cited by examiner

*Primary Examiner* — Brian P Mruk

(74) *Attorney, Agent, or Firm* — Raef M. Shaltout

(57) ABSTRACT

Described are fabric care compositions, comprising a builder and an aqueous dispersion comprising an ethylene acrylic acid copolymer and a fragrance.

6 Claims, No Drawings

ETHYLENE ACRYLIC ACID COPOLYMER AQUEOUS DISPERSIONS FOR FRAGRANCE RELEASE IN LAUNDRY DETERGENTS

CROSS REFERENCE TO RELATED APPLICATIONS

This application is a 35 USC §371 national phase filing of PCT/US2011/064424 filed Dec. 12, 2011, which claims the benefit of U.S. Application No. 61/424,497, filed Dec. 17, 2010.

FIELD

The present application relates to fabric care compositions.

BACKGROUND

Many fabric care compositions contain water insoluble actives, such as fragrances, which can evaporate, thereby decreasing consumer satisfaction. One strategy to overcome such difficulties is to insulate or encapsulate the water insoluble active. In the past, encapsulation has required high shear and/or solvent exchange processes. Thus, what is needed are improved methods and compositions containing encapsulated or otherwise protected water insoluble fabric care actives, particularly fragrances, such that retention of fragrances within laundered fabrics is increased.

SUMMARY

In one embodiment, the present invention provides fabric care compositions, comprising a builder and an aqueous dispersion comprising an ethylene acrylic acid copolymer and a fragrance.

In another embodiment, the present invention provides methods for encapsulating fragrances with an ethylene/acrylic acid copolymer, comprising raising the pH of an ethylene/acrylic acid copolymer mixture above about 7, dispersing the fragrance in the mixture, and precipitating the copolymer, thereby forming a shell around the fragrance.

DETAILED DESCRIPTION

In one embodiment, the present invention provides fabric care compositions, comprising a builder and an aqueous dispersion comprising an ethylene acrylic acid copolymer and a fragrance.

"Fabric care" relates to compositions to be applied to fabric. Examples of fabric care compositions include laundry detergents, stain treatment compositions, and fabric softeners. Preferably, the fabric care composition is a laundry detergent. In one embodiment, the laundry detergent is a powdered laundry detergent. In one embodiment, the laundry detergent is a liquid laundry detergent. In one embodiment, the pH of the laundry detergent is greater than 8, preferably greater than 9.

In an alternative embodiment, liquid dishwashing detergents, machine dishwashing liquids, hand dishwashing detergents, industrial cleaners, hard surface care products, and odor neutralizing products are contemplated.

Examples of fabric care builders include those phosphates, carbonates, silicates, zeolites, percarbonates, and citrates suitable in laundry applications.

Fragrances include any component which provides a pleasant scent. Examples include scents that are floral, ambery, woody, leather, chypre, fougère, musk, vanilla, fruit, and/or citrus. Fragrances are often oils obtained by extraction of natural substances or synthetically produced. Fragrances may be simple (one essence) or complex (a mélange of essences). Fragrances can be aldehydes, ketones, or oils obtained by extraction of natural substances or synthetically produced as described above. Often, fragrances are accompanied by auxiliary materials, such as fixatives, extenders, stabilizers and solvents. In one embodiment, the fragrance is one conventionally used in laundry detergents. In one embodiment, the ratio of ethylene acrylic acid copolymer to fragrance in the mixture is from 4:1 to 1:2. In one embodiment, the encapsulation efficiency, which is the percentage of encapsulated fragrance out of total loaded fragrance, is greater than 80%, preferably greater than 90%.

Copolymerizing ethylene with acrylic acid yields ethylene-acrylic acid (EAA) copolymers, which are known as flexible thermoplastics for blister packaging and the like. A preferred ethylene acrylic acid copolymer comprises greater than about 15 wt % acrylic acid, preferably greater than about 17 wt % acrylic acid, more preferably about 20 wt % acrylic acid. It should be understood that ranges recited in this disclosure include all subcombinations of ranges.

A preferred EAA copolymer is PRIMACOR 5990 copolymer (20 wt % acrylic acid), which has a melt index of 1300 g/10 minute (ASTM Method D-1238 at 190° C.) and a Brookfield viscosity of 13,000 cps at 350° F., and is available from The Dow Chemical Company. Another preferred EAA copolymer is PRIMACOR 5980i copolymer (20.5 wt % acrylic acid), which has a melt index of 300 g/10 minute (ASTM Method D-1238 at 190° C.), available from The Dow Chemical Company. EAA copolymers are also available under the tradename NUCREL 2806, available from E.I. du Pont de Nemours and Company, Inc. Ethylene-acrylic acid and ethylene-methacrylic acid copolymers, are described in U.S. Pat. Nos. 4,599,392, 4,988,781, and 5,938,437, each of which is incorporated herein by reference in its entirety.

Mechanical dispersion, such as a Parr reactor, is used to create the aqueous dispersion. Alternatively, mixing polymer, water, and base at an elevated temperature can be employed.

In one embodiment, the solids content of the aqueous dispersion is in a range from about 10% by weight to about 30% by weight, preferably about 20% by weight.

In turn, the aqueous dispersion is present in a range from about 0.025 wt % to about 2 wt %, preferably about 0.25 wt % to about 2 wt %, by weight of the fabric care composition.

The ethylene acrylic acid copolymer is present in a range from about 15 wt % to about 60 wt % of solids by weight of the aqueous dispersion.

It is understood that the aqueous dispersion comprising an ethylene acrylic acid copolymer can include additional components. In a preferred embodiment of the present invention, the aqueous dispersion comprises an ethylene acrylic acid copolymer and a metallocene catalyzed polyolefin. Typically, the ethylene acrylic acid copolymer and metallocene catalyzed polyolefin is in a polymer ratio of about 40:60 to about 15:85. In these embodiments, the solids content of the aqueous dispersion is in a range from about 30% by weight to about 50% by weight, preferably about 40% by weight. The ethylene acrylic acid copolymer is present in a range from about 15 wt % to about 60 wt % of the solids by weight of the aqueous dispersion, preferably in a range from about 35 wt % to about 45 wt % of the solids. This correlates to ethylene acrylic acid copolymer being present in a range from about 1 wt % to about 25 wt % by weight of the aqueous dispersion, preferably in a range from about 5 wt % to about 20 wt %.

Metallocene catalyzed polyolefins are polyolefins produced with a metallocene catalyst as described in U.S. Pat.

Nos. 4,701,432, 5,322,728, and 5,272,236, each of which is incorporated herein by reference in its entirety. As a specific embodiment of the present invention, the metallocene catalyzed polyolefins are polyethylenes produced with a metallocene catalyst. Such metallocene catalyzed polyethylenes are available e.g. from The Dow Chemical Company under the trademark AFFINITY or ENGAGE (ethylene/octene copolymers) and from Exxon Chemical Company under the trademark EXACT (ethylene/butene copolymers, ethylene/hexene copolymers, or ethylene/butene/hexene terpolymers). In one embodiment, the metallocene catalyzed polyolefin is at least one of ethylene/octene copolymers, ethylene/butene copolymers, ethylene/hexene copolymers, ethylene/propylene or ethylene/butene/hexene terpolymers, preferably an ethylene octene copolymer. In another embodiment, the metallocene catalyzed polyolefin is a propylene/alpha-olefin copolymer, which is further described in details in the U.S. Pat. Nos. 6,960,635 and 6,525,157, each of which is incorporated herein by reference in its entirety. Such propylene/alpha-olefin copolymers are commercially available from The Dow Chemical Company, under the tradename VERSIFY™, or from ExxonMobil Chemical Company, under the tradename VISTAMAXX™.

In one embodiment, the ethylene acrylic acid copolymer and metallocene catalyzed polyolefin are melt-kneaded in an extruder along with water and a neutralizing agent, such as ammonia, potassium hydroxide, or a combination of the two, to form an aqueous dispersion.

In another embodiment, the present invention provides methods for encapsulating fragrances with an ethylene/acrylic acid copolymer, comprising raising the pH of an ethylene/acrylic acid copolymer mixture above about 7, dispersing the fragrance in the mixture, and precipitating the copolymer, thereby forming a shell around the fragrance.

The polyolefin acid copolymer is one that is capable of being surface active. In a preferred embodiment, the polyolefin acid copolymer is one that can transition between a surface active state and a non-surface active state.

In the surface active state, the polyolefin acid copolymer has partitioned to the interface between the hydrophobic active and the water, forming a protective gel encapsulating the active. For example, ethylene/acrylic acid copolymer becomes surface active upon combination with water and a base, provided that the pH is greater than about 7.

If the pH is then reduced below about 7, the ethylene/acrylic acid copolymer loses its surface active property and precipitates. Advantageously, this precipitation results in encapsulation of the active component that was suspended when the copolymer was surface active, thus forming a "hard" shell.

In one embodiment, methods of the present invention include precipitating the copolymer, thereby forming shells around the active particles. In one embodiment, the particle defined by the shell has a particle size of less than 750 nm, preferably less than 600 nm, preferably less than 500 nm, preferably greater than 100 nm, preferably greater than 200 nm, and preferably greater than 250 nm under pH neutral to alkaline conditions, measured by dynamic light scattering.

Thus, in one embodiment, the polyolefin acid copolymer is an ethylene/acrylic acid copolymer that has from about 9 to about 22 weight percent of acrylic acid units, preferably about 18 to about 22 weight percent of acrylic acid units, preferably from about 19 to about 21 percent of acrylic acid units, and most preferably about 20 acrylic acid units. Examples of commercially available ethylene/acrylic acid copolymers include those sold under the tradenames PRIMACOR 5980i, PRIMACOR 5986, and PRIMACOR 5990i, all available from The Dow Chemical Company, and NUCREL 2806, available from E.I. du Pont de Nemours and Company, Inc. Ethylene-acrylic acid and ethylene-methacrylic acid copolymers, are described in U.S. Pat. Nos. 4,599,392, 4,988,781, and 5,938,437, each of which is incorporated herein by reference in its entirety.

In one embodiment, a short chain alcohol is included in the dispersion of the PRIMACOR polymer to reduce the amount of undispersed material after the addition of the base, as described in U.S. Pat. No. 3,798,194, which is incorporated herein by reference in its entirety.

In one embodiment, the upper limit concentration of polyolefin acid copolymer in water is ~30%. The resulting dispersion can be diluted down, preferably to a dispersion that is between 10% and 26% polyolefin acid copolymer as the starting point to which the hydrophobic active is added.

In one embodiment, the polyolefin acid copolymer is present in the non-aqueous ingredients from about 4.5 weight percent to about 50 weight percent, preferably about 6.3 weight percent to about 17 weight percent, most preferably about 9 weight percent.

In one embodiment, the dispersion that is between 10% and 26% polyolefin acid copolymer as the starting point to which the hydrophobic active is added.

The mixture is formed by combining polyolefin acid copolymer and a base, and then adding water. In one embodiment, the base is NaOH, KOH, or triethanolamine.

The active preferably is added to the mixture.

In one embodiment, the active and the mixture are emulsified. Emulsification can be performed using any conventional method.

In one embodiment, during combination, the pH remains greater than about 7. If necessary, the pH can be maintained at above about 7 to prevent precipitation of the polyolefin acid copolymer.

In one embodiment, precipitating includes lowering the pH of the mixture. In one embodiment, the pH is lowered with citric acid.

In one embodiment, the fabric care composition further comprises conventional laundry adjuvants. In one embodiment, the fabric care composition further comprises anion and nonionic surfactants, optionally cationic surfactants. In one embodiment, the surfactant is present in an amount from greater than 20 wt % by weight of the composition, preferably greater than 25 wt %, more preferably greater than 26 wt %, and less than 60 wt %, preferably less than 55 wt %, more preferably less than 50 wt % by weight of the composition.

In one embodiment, the fabric care composition further comprises at least one of soil release polymers, fatty acid soaps, cellulose derivatives, dispersants, hydrotropes, bleaching agents, or enzymes. In one embodiment, the fabric care composition further comprises at least one of water, ethanol, polyethylene glycol, or sodium xylene sulfonate.

The amount of optional ingredients effective for achieving the desired property provided by such ingredients can be readily determined by one skilled in the art.

EXAMPLES

The following examples are for illustrative purposes only and are not intended to limit the scope of the present invention. All percentages are by weight unless otherwise specified.

Example 1

Fabric care compositions of the present invention include aqueous dispersions comprising an ethylene acrylic acid copolymer and a fragrance as listed in TABLE 1:

TABLE 1

| | Batch 1 | Batch 2 | Batch 3 | Batch 4 |
|---|---|---|---|---|
| PRIMACOR 5990i (19.68% solids) | 14.3 wt % | 16.7 wt % | — | — |
| PRIMACOR 5980i (23.72% solids) | — | — | 19.8 wt % | 16.9 wt % |
| Simple Fragrance A | 28.6 wt % | — | — | — |
| Complex Fragrance B | — | 16.7 wt % | 16.7 wt % | 28.6 wt % |
| Water | 57.1 wt % | 66.6 wt % | 63.5 wt % | 54.5 wt % |

To prepare the encapsulation, a PRIMACOR in water dispersion is made. Appropriate amounts of PRIMACOR 5980i or 5990i 20% ethylene acrylic acid resin, potassium hydroxide, and water are placed in a 300 mL Parr reactor vessel fitted with a Cowles blade. The material is heated to 120° C. while mixing slowly. Once the set temperature is reached, the mixer is run on high (1800 rpm) for about 25 minutes. While still mixing on high, the sample is diluted with water fed into the reactor with an HPLC pump at a rate of 40 mL/min to the desired concentration of % solids by weight based on the amount of PRIMACOR. Heat is removed and stirring continues until the temperature cools to at least 45° C. The Parr is then opened and the dispersion is collected, and the desired amount of PRIMACOR in water dispersion is weighed into a glass bottle.

Simple Fragrance A is d-limonene. Complex Fragrance B is a mixture of essences that is conventionally used in laundry applications, and has at least seven chromatographically discernable peaks. The desired amount of neat fragrance is added to the bottle containing the desired amount of PRIMACOR in water dispersion. A standard overhead homogenizer (PowerGen 700D, Fisher Scientific) is applied to the mixture at a speed of 10,000 rpm for about 1 minute at room temperature.

Particle sizes and distributions are first characterized by Coulter LS230 Particle Size Analyzer (Beckman Coulter) to confirm the unimodal and submicron size distributions of the particles. Then, the particles are further characterized using Brookhaven 90Plus Particle Size Analyzer (Brookhaven Instruments Corp.) to obtain more accurate measurement of nanometer-scale particle sizes.

Example 2

An aqueous dispersion comprising an ethylene acrylic acid copolymer and a fragrance according to Batch 3 was made and tested substantially according to the protocol of Example 1. The hydrodynamic diameter of Batch 3 at pH 7.1 was 364 nm. The hydrodynamic diameter of Batch 3 at pH 10.4 was 571 nm.

To evaluate fragrance encapsulation efficiency, Batch 3 was quantified by comparing the amount of free un-encapsulated components to total amount of each component. Specifically, measurements of the total fragrance in dispersions were made by extracting the dispersions with acetonitrile and then analyzing with liquid chromatography; measurements of free un-encapsulated were conducted by filtering through a centrifugal device of 30,000 MWCO ("molecular weight cut-off"; Almicon® Ultra series, Millipore Corporation) and analyzing with liquid chromatography. All 7 major components were encapsulated in 5980i, with high efficiencies ranging from 88% to 100%. Comparing the total areas of the peaks detected from the filtrate and from the dispersion, the overall encapsulation efficiency is 91.8%.

Example 3

Exemplary fabric care compositions contain the components recited in TABLE 2 on a weight/weight basis (wt. %).

TABLE 2

| | Batch A (Inventive) | Batch Y (Comparative) | Batch Z (Comparative) |
|---|---|---|---|
| Dodecylbenzene-sulfonic acid | 10 wt % | 10 wt % | 10 wt % |
| ECOSURF ™ SA-9 surfactant | 5 wt % | 5 wt % | 5 wt % |
| Complex Fragrance B | 1 wt % | 1 wt % | 1 wt % |
| PRIMACOR 5980i | 1 wt % | — | — |
| Citric acid | Adjust pH to 8.5 | — | — |
| SoftCAT ™ Polymer SL-60 | 0.1 wt % | 0.1 wt % | 0.1 wt % |
| Water | 82.9 wt % | 83.9 wt % | 83.8 wt % |
| BRIJ ® 56 polyethylene glycol hexadecyl ether | — | — | 0.06 wt % |
| Cottonseed oil | — | — | 0.02 wt % |

Batch A was prepared by the following procedure:

1) 20 g of PRIMACOR 5980i in water dispersion was first weighed into a glass bottle, followed by adding 4.7 g of neat Complex Fragrance B. A standard overhead homogenizer was applied to the mixture at a speed of 10,000 rpm for about 1 minute.
2) A representative detergent solution was prepared by adding LAS (dodecylbenzene sulfonic acid) and SA9 (55.0-80.0% C6-C12 ethoxylated, propoxylated alcohols, 15.0%-40.0% C10-C16 ethoxylated, propoxylated alcohols, and 1.0-2.0% polyethylene oxide) into water to a concentration of 10 wt % and 5 wt %, respectively; the mixture was stirred on magnetic plate for 10 minute at room temperature.
3) A concentrated SL60 (91.0% cationic hydroxyethyl cellulose, 5.6% water, 1.5% sodium acetate, 1.5% sodium chloride, and 0.4% isopropanol) solution of 1 wt % was prepared separately by adding SL60 powder into water and stirred on magnetic plate for 15 minute.
4) 2.1 g of the product obtained in step 1) was mixed with 37.9 g of the solution in step 2), so that the final concentration of Complex Fragrance B was 1 wt %. The mixture was stirred on magnetic plate for 5 minute. The solution was then adjusted to pH=8.47 with 0.1 M Citric acid solution.
5) 2 g of SL60 in step 3) was added into 18 g of solution obtained in step 4) in a drop-by-drop manner under magnetic stirring. After all SL60 solution was added, the mixture was stirred for another 20 minute.

The preparation method for Comparative Batch Y differed from that of Batch A only in steps 1) and 4): instead of encapsulation with PRIMACOR, 0.4 g neat Complex Fragrance B was added into 39.6 g solution obtained in step 2), so that the final concentration of Complex Fragrance B was 1 wt %.

The preparation method for Comparative Batch Z differed from that of Batch A only in steps 1) and 4): In step 1), 20 g of neat Complex Fragrance B, 0.4 g of cottonseed oil, 1.2 g of BRIJ® 56 (pre-heated in 55° C. oven), and 10 g of water were sequentially added into a glass bottle. A standard overhead homogenizer was applied to the mixture at a speed of 10,000 rpm for about 1 minute 30 seconds. In step 4), 0.77 g Brij 56/Complex Fragrance B was added into 48.2 g solution obtained in step 2), so that the final concentration of Complex Fragrance B was 1 wt %.

The effect of these formulations on Complex Fragrance B release from fabric was evaluated by a model wash followed by headspace gas chromatography (HSGC) analysis. Briefly, the formulations obtained in step 6) were diluted 40 times with ultra-pure water, to mimic the dilution ratio of typical European laundry. Clean cotton swatches (cotton 400, Scientific Services S/D, Inc.) of 3 by 4 inches were immersed into the solutions contained in 200 ml capacity bottles. The bottles were then secured onto a horizontal mechanical shaker, and shaken at a speed of 3 shakings per second for 30 minutes. At the end of shaking, swatches were taken out of the bottles using tweezers and flattened onto a stainless screen for drying at room temperature.

After 30 min drying, when the swatches were still wet, a set of them were folded and sealed into 5-ml vials for HSGC evaluation 1 hour layer. After another 60 min drying, the swatches were dry and a set of them were collected into 5-ml vials and analyzed with HSGC 17 hours later.

TABLE 3 summarizes the peak area of one major peak of Complex Fragrance B released from the sets of swatches:

TABLE 3

| | Batch A (Inventive) | Batch Y (Comparative) | Batch Z (Comparative) |
|---|---|---|---|
| Peak area, wet swatches | 4.03 | 3.74 | 3.17 |
| Peak area, dry swatches | 0.48 | Not detected | Not detected |

The inventive batch (Batch A) enabled a better retention of fragrance component than un-encapsulated fragrance (Batch Y) or surfactant-encapsulated fragrance (Batch Z), more than 17 hours after wash.

It is understood that the present invention is not limited to the embodiments specifically disclosed and exemplified herein. Various modifications of the invention will be apparent to those skilled in the art. Such changes and modifications may be made without departing from the scope of the appended claims.

Moreover, each recited range includes all combinations and subcombinations of ranges, as well as specific numerals contained therein. Additionally, the disclosures of each patent, patent application, and publication cited or described in this document are hereby incorporated herein by reference, in their entireties.

The invention claimed is:

1. A fabric care composition, comprising:

a builder; and an aqueous dispersion comprising:

an ethylene acrylic acid copolymer, a fragrance, and a metallocene catalyzed polyolefin, wherein the metallocene catalyzed polyolefin comprises an ethylene/octene copolymer, wherein the aqueous dispersion is obtainable by a method comprising precipitating the copolymer, thereby forming shells around the fragrance.

2. The fabric care composition of claim 1, wherein the builder is sodium tripolyphosphate, a silicate, a citrate, a carbonate, or a percarbonate.

3. The fabric care composition of claim 1, further comprising a surfactant.

4. The fabric care composition of claim 1, further comprising a bleaching agent.

5. The fabric care composition of claim 1, wherein the aqueous dispersion is in a range from about 0.05 wt % to about 2 wt % of the fabric care composition.

6. The fabric care composition of claim 1, wherein the particle defined by the shell has a particle size of less than 750 nm under pH neutral to alkaline conditions, measured by dynamic light scattering.

* * * * *